United States Patent [19]

Sieffert

[11] 4,039,117

[45] Aug. 2, 1977

[54] CARTON DIVIDER

[75] Inventor: William G. Sieffert, Joliet, Ill.

[73] Assignee: Hoerner Waldorf Corporation, St. Paul, Minn.

[21] Appl. No.: 713,655

[22] Filed: Aug. 12, 1976

[51] Int. Cl.[2] ..... B65D 5/48

[52] U.S. Cl. ..... 229/15; 229/27; 229/42

[58] Field of Search ..... 229/15, 42, 27, 28

[56] References Cited

U.S. PATENT DOCUMENTS

| | | | |
|---|---|---|---|
| 1,999,909 | 4/1935 | Lupton | 229/15 |
| 2,006,822 | 7/1935 | Andrews | 229/15 |
| 2,154,085 | 4/1939 | Bergstein | 229/28 R X |
| 2,693,297 | 11/1954 | Bolding | 229/27 UX |
| 3,049,279 | 8/1962 | Mairs et al. | 229/27 |
| 3,056,537 | 10/1962 | Vesak | 229/42 X |
| 3,058,643 | 10/1962 | Wilson | 229/15 |
| 3,166,229 | 1/1965 | Sherman et al. | 229/27 |
| 3,452,920 | 7/1969 | Milne et al. | 229/27 |
| 3,829,001 | 8/1974 | Wheeler | 229/15 X |
| 3,931,924 | 1/1976 | Gardner et al. | 229/42 X |

*Primary Examiner*—Davis T. Moorhead
*Attorney, Agent, or Firm*—Jerry F. Best

[57] ABSTRACT

A one-piece, die cut partition made from foldable sheet-like material which folds into a two-cell rectangular divider with single thickness material around the perimeter and double thickness material in the center partition, the partition being such that it may be easily set up by hand and requires no additional retention devices or material although it may be taped or stapled.

2 Claims, 5 Drawing Figures

CARTON DIVIDER

BACKGROUND OF THE INVENTION

1. Field of the Invention

This invention relates to dividers or partitions which are inserted into a fully erected container to separate items which are to be placed therein.

2. Description of the Prior Art

Most full depth cell dividers have more than one piece which are fitted together in a telescoping manner by use of partially cut slots in each piece. There is a need for a divider which provides double thickness protection to the contents on all sides, and particularly one which has double thickness between the cells of the divider itself and single thickness material around the perimeter so that the perimeter of material, in combination with the outer walls of the container will provide double thickness protection to the contents from the outside.

SUMMARY OF THE INVENTION

A one-piece die-cut blank foldable into a divider by first folding it into a tube and then folding it upon itself to form a partition with double thickness center panels and single thickness rectangular portions comprising each cell of the divider.

DETAILED DESCRIPTON OF THE PREFERRED EMBODIMENT

Figure 2:
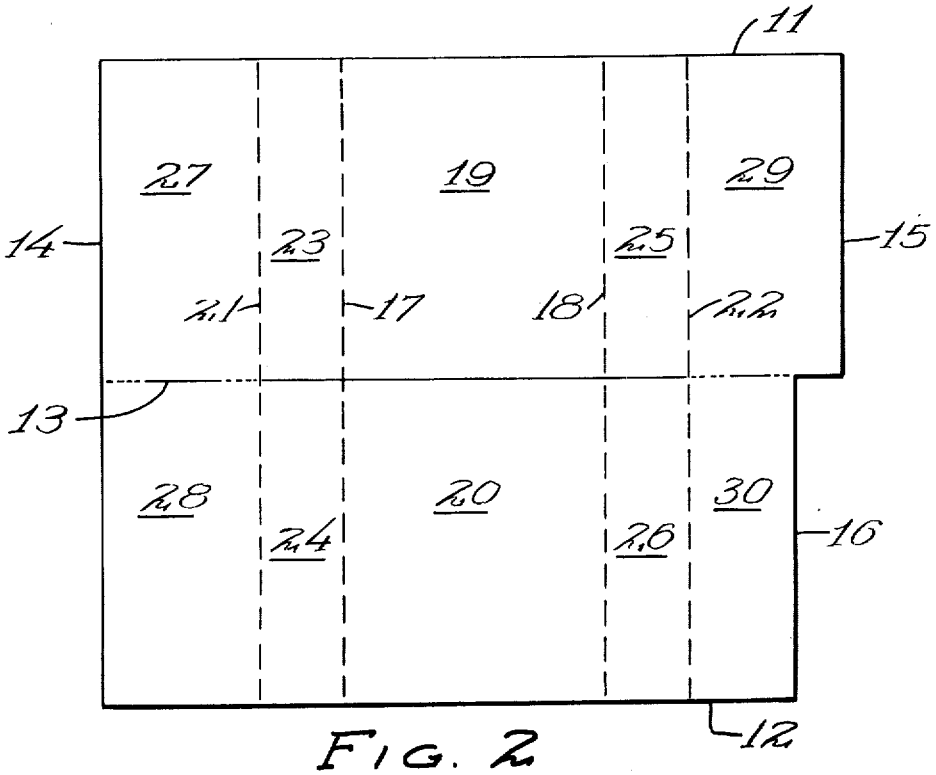
FIG. 2 is a plan view of a blank adapted to be folded into the partition of FIG. 1.

The partition 10 is one which is shown in narrow rectangular proportion but it should be understood that the proportioning of the particular configuration is a matter of choice. The blank shown in FIG. 2 is substantially rectangular in shape and is defined by top and bottom horizontal and parallel edges 11 and 12. Through the center of the blank is a line 13 which is partially cut and partially scored which also extends horizontally. The left side of the blank is defined by a vertical edge 14 and the right hand side of the blank is defined by two vertical edges, 15 and 16, wherein edge 16 is inset slightly from the edge 15 at a point colinear with the fold line 13.

The blank is defined further by four vertical fold lines which are spaced from one another intermediate the lateral edges of the blank and extend from the top edge 11 to the bottom edge 12. Vertical fold lines 17 and 18 define two panels 19 and 20 which are substantially rectangular in shape and are spaced one above the other and are separated by a portion of the line 13 which is cut completely through. These form the outer major walls of the partiton as will be described later. On either side of the two panels 19 and 20 are four minor walls, defined by two additional vertical fold lines 21 and 22, and can be seen on the left as 23 and 24, and on the right hand side as 25 and 26, respectively. These narrower panels are not connected to one another but are separated by a portion of the line 13 which is cut through and therefore separate to form the narrow sides of each cell in the final folded configuration.

Figure 1:
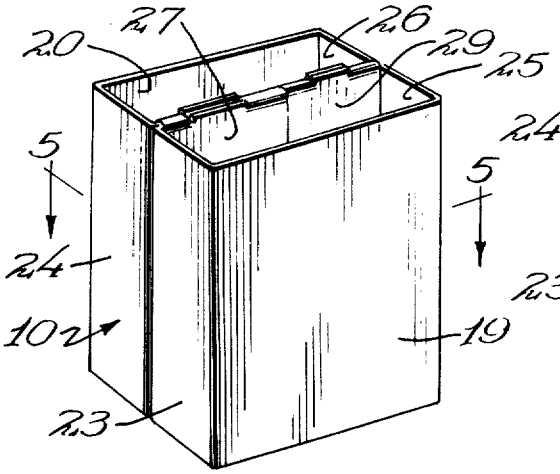
FIG. 1 is a perspective view of a fully erected partition embodying the present invention.
Figure 4:
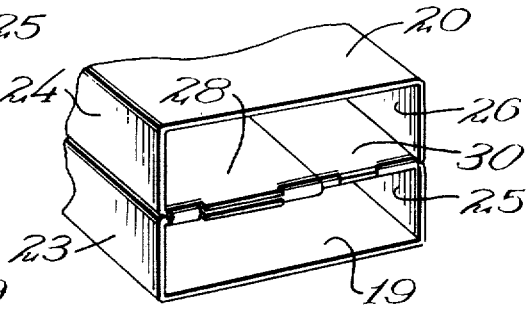
FIG. 4 is a perspective view of a portion of the assembled partition in FIG. 1 showing the top end to better illustrate the relationship of folded surfaces.
Figure 5:
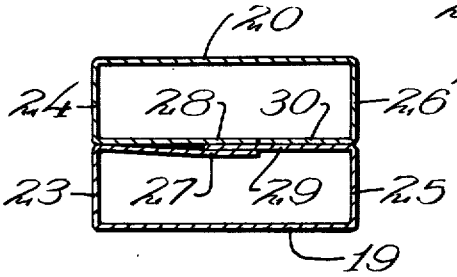
FIG. 5 is a top secton view of the partition shown in FIG. 1 taken along the section lines 5—5 in FIG. 1.
Figure 3:
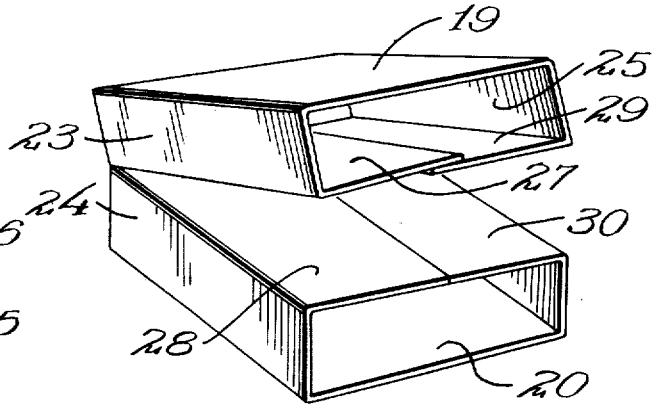
FIG. 3 is a perspective view of the blank of FIG. 2 partially erected.

The center partition member in its final orientation is approximately the same size as the outer panels 19 and 20, and is made of two sets of panels which lie at the outside edges of the blank shown as 27, 28, 29 and 30 which have at least a portion of the line 13 which connects the vertical pairs intact and formed as a scored hinge line. The lateral width of the two panels 27 and 28 along with the lateral width of the panel 30 equal substantially the same lateral width as the outer panels 19 and 20. The upper right hand panel 29 extends laterally beyond the edge of the lower panel 30 and it is inserted between the folded panels 27 and 28 as shown in FIG. 5 which tends to stablize the partition. The lateral extent of the center partition is fixed by the outer edge of the panel 27 which then contacts the outside edge 16 of the panel 30 when the final folded position is obtained and the edge 15 of the panel 29 is inserted between the two edges 14 and 15.

It can be seen that the partition divider requires no staples or tape to hold it in position inside the outer container, not shown.

I claim:

1. A blank adapted to be erected into a two-cell partition with a double thickness center and rectangular cells, said blank made from flat foldable sheet-like material, said blank comprising:

a substantially rectangular sheet of said material;

said sheet being defined along its top and bottom edges by horizontal edges and along a first lateral edge by a vertical edge;

said blank being divided into top and bottom edges by a horizontally extending combined line cut and fold line extending between the lateral edges of said blank;

the lateral edge opposite said first lateral edge being divided into two parallel portions, a first portion being above said horizontal fold line and being spaced outwardly from a second of said edges opposite a said first lateral edge;

a pair of vertically oriented hinge lines extending from said top to said bottom edges and defining therebetween outer wall panels, said outer wall panels being separated along said horizontal line by a line cut;

a second pair of vertical fold lines spaced outwardly from said first pair of vertically oriented fold lines and defining four minor wall panels, one each on either lateral side of said outer wall panel and similarly separated from top to bottom by a line cut along said horizontal line, one of said minor wall panels disposed above said horizontal line being of greater width than the minor wall panel disposed immediately below said horizontal line;

a first pair of inner partition members defined by said first lateral edge and a first of said second pair of fold lines, said first pair of inner partition members having uniform width and separated by a portion of said horizontal line having at least a portion thereof formed as a scored hinge line.

2. A two-cell partition with double thickness center and rectangular cells, said partition made from foldable sheet-like material, said partition comprising:

two outer rectangular panels arranged parallel to one another and spaced apart;

each of said outer panels having connected to the lateral edges thereof two minor walls extending inwardly perpendicular to said outer panels with respective minor walls from adjacent lateral edges of said outer walls arranged in edge abutting relationship near the center of said partition;

two pairs of center partition panels positioned to form the center of said partition with one of said pair having lateral dimensions of combined magnitude substantially equal to the lateral width of said outer panels, while the other of said pair having lateral dimensions of greater magnitude than the lateral width of said outer panels such that said other pair are in overlapping relationship to aid in maintaining the partition in an erected condition without bonding; and each of said pairs of center partition panels being rectangular panels hingedly connected along the top edges and connected along the top edge and lying in face to face contact to form a double thickness, the outer lateral edge of each panel connected to an adjacent inwardly facing lateral edge of said four minor walls.

* * * * *